United States Patent [19]

Lee

[11] Patent Number: 4,738,640

[45] Date of Patent: Apr. 19, 1988

[54] SPADE LUG

[76] Inventor: Noel Lee, 47 W. Park Dr., Daly City, Calif. 94015

[21] Appl. No.: 42,421

[22] Filed: Apr. 24, 1987

Related U.S. Application Data

[63] Continuation-in-part of Ser. No. 934,178, Nov. 24, 1986.

[51] Int. Cl.[4] ..... H01R 13/02

[52] U.S. Cl. ..... 439/884

[58] Field of Search ..... 439/877–889, 439/891

[56] References Cited

U.S. PATENT DOCUMENTS

| | | | |
|---|---|---|---|
| 422,058 | 2/1890 | McIntyre . | |
| 582,462 | 5/1897 | Dickerson . | |
| 783,061 | 2/1905 | Mills . | |
| 2,264,040 | 11/1941 | Johnson et al. . | |
| 3,221,294 | 11/1965 | Roberts | 439/877 |
| 3,728,669 | 4/1973 | Churla . | |
| 3,937,403 | 2/1976 | Lawson | 439/882 X |
| 4,291,934 | 9/1981 | Kund | 439/879 |

*Primary Examiner*—Eugene F. Desmond

*Attorney, Agent, or Firm*—Warren B. Kice

[57] ABSTRACT

A spade lug for connecting an electrical conductor to an electrical terminal in which two legs extend from a base member in a spaced parallel relation. An extension is formed on one of the legs and extends at two angles thereto in two different planes.

4 Claims, 1 Drawing Sheet

SPADE LUG

CROSS-REFERENCE TO RELATED APPLICATIONS

This application is a continuation-in-part application of Applicant's application Ser. No. 934,178, filed on Nov. 24, 1986.

BACKGROUND OF THE INVENTION

This invention relates to a spade lug, and more particularly to a spade lug for making an electrical connection between a conductor attached to the spade lug and one of several different electrical terminals.

Spade lugs are often connected to an electrical conductor in order to facilitate a connection between the conductor and a barrier strip, a terminal block, or a single terminal such as that found on an audio amplifier, loudspeaker, or the like. Although the terminals on most electrical components use a threaded binding post, for which a spade lug is ideally suited, other types of terminals are becoming more popular. For example, the terminals on many electronic components use a spring-loaded clip, or clasp which, when pushed, exposes an opening for receiving an electrical conductor. Upon release, the spring-loaded clasp engages the conductor or pin to establish an electrical connection between the conductor and the terminal.

Thus, when an electrical component having a barrier strip, a terminal block, or a threaded binding post is replaced by a component having a different terminal, all spade lugs utilized to connect conductors to the old component have to be removed or replaced, which is expensive and time consuming. Another problem exists when the terminal is in the form of the aforementioned spring-loaded terminal utilizing a spring-loaded clip or clasp, since pin conductors are often crimped or soldered to the conductor in order to facilitate the connection between the conductor and the terminal. However, the connection is such that the pin extends substantially horizontally and the weight of the conductor thus creates a lever arm which puts stress on the crimped or soldered connection and thus compromises the integrity of the connection.

SUMMARY OF THE INVENTION

It is therefore an object of the present invention to provide a spade lug which can be utilized in connection with a barrier strip, a terminal block or a terminal having a threaded binding post or an opening for receiving a conductor or a pin type connector.

It is a further object of the present invention to provide a spade lug of the above type which is formed by two parallel leg portions adapted to extend around a binding post of one type of electrical terminal, with one of the leg portions having an extension for extending in an opening in another type of electrical terminal.

It is a still further object of the present invention to 0 provide a spade lug of the above type which is designed to minimize stress on the connection between it and a conductor.

Toward the fulfillment of these and other objects, the spade lug of the present invention comprises a pair of spaced parallel legs extending from a base member which is preferably in the form of a sleeve. The legs extend at an angle to the axis of the sleeve and an extension is formed on one of the legs and extends at two angles thereto in two planes.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings wherein.

DESCRIPTION OF THE PREFERRED EMBODIMENT

Figure 1:
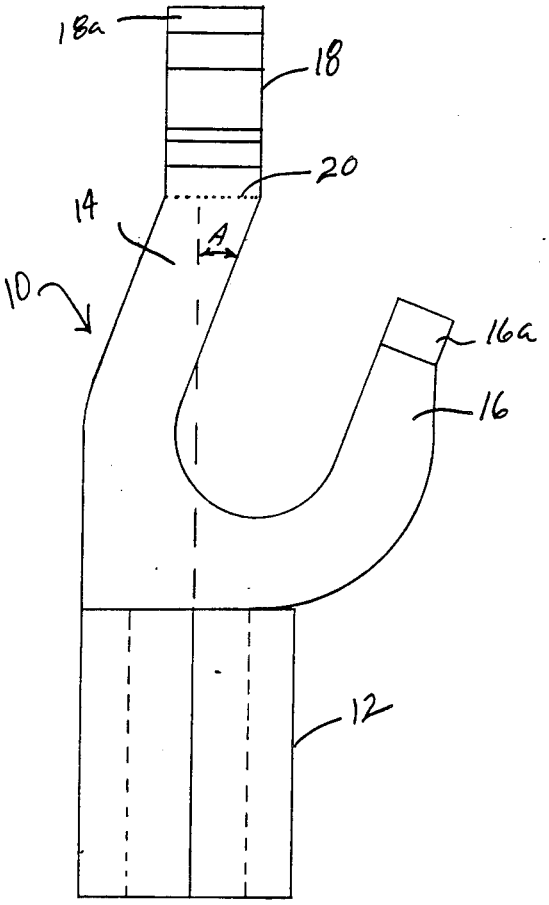
FIG. 1 is a front elevational view of the spade lug of the present invention.

Referring to the drawings, the reference numeral 10 refers, in general, to the improved spade lug according to the present invention. The spade lug 10 is found by a strip, or plate, of electrical current conducting material, such as copper, brass, or copper or brass-plated metal, and is stamped or otherwise cut into the configuration shown.

The lower portion of the spade lug 10 includes a base portion which is formed into a cylindrical crimping barrel, or sleeve, 12 by bending the lower opposite edge portions of the strip inwardly until they abutt. The upper portion of the strip is cut into a generally U-shaped pattern with the legs 14 and 16 of the U extending at an angle A to the longitudinal axis of the sleeve 12, which axis is shown by the dashed line in FIG. 1. The upper end portion of the leg 14 has an extension 18 which extends parallel with the longitudinal axis of the sleeve 12. Thus the longitudinal axis of the extension 18 is disposed at the angle A to the longitudinal axis of the leg 14. The junction between the extension 18 and the leg 14 can be scored, or the like, as shown at 20 so that the extension can be easily snapped off from the leg, for reasons to be described.

Figure 2:
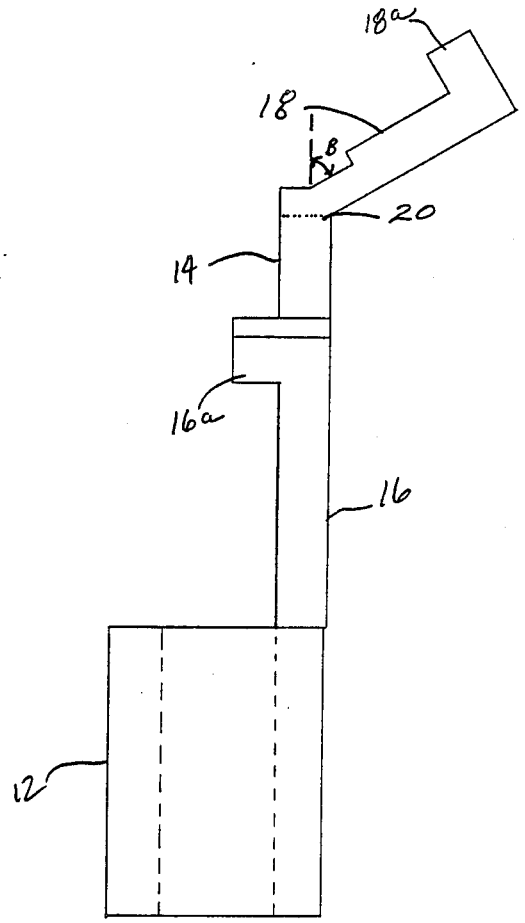
FIG. 2 is a side elevational view of the spade lug of FIG. 1.

The end 16*a* of the leg 16 is bent forward, or towards the sleeve 12, as shown in FIG. 2 to extend perpendicular to the remaining portion of the leg, for reasons that will be explained.

As shown in FIG. 2, the extension 18 is bent backward, or away from the sleeve 12 at an angle B to the longitudinal axis of the leg 14 shown by the dashed line in FIG. 2. The extension 18 thus extends at two angles to the leg 14 in two different planes.

The end 18*a* of the extension 18 is bent forward to extend approximately perpendicular to the remaining portion.

According to a preferred embodiment the angles A and B can be 20° and 60°, respectively, it being understood that these angles can vary within the scope of the invention.

Prior to use, a conductor (not shown) is stripped of insulation at its end portion and the latter placed in the sleeve 12. The latter is then crimped over the stripped conductor portion by a pair of pliers, or the like, to secure the conductor in the sleeve 12, it being understood that a soldered connection can be made in place of, or in addition to, the crimped connection.

The spade lug 10 can be used in a conventional manner by placing it over a threaded binding post (not shown) associated with a barrier strip, a terminal block or an individual terminal of an electrical component with the legs 14 and 16 flanking the post. Thus a binding nut (not shown) associated with the post can be tightened over the spade lug to secure it around the post and thus complete the electrical connection between the conductor in the sleeve 12 and a similar conductor (not shown) connected to the binding post. The bent portions 16*a* and 18*a* are provided for aiding in securing or stabilizing the connection and can engage raised portions, or the like, of the terminal to prevent rotation or angular movement of the spade lug 10 relative to the terminal. Prior to its insertion over the binding post the extension 18 can be snapped off the leg 14 about the scored line 20 so that the extension will not interfer with the terminal.

The spade lug 10 of the present invention also can be used with a terminal (not shown) of the type having a through opening, or bore, for receiving a conductor or a pin type connector which is connected to the conductor. These types of terminals include a spring-loaded button which is pushed to expose the opening, or bore, or a threaded nut which extends over a shaft, or post, having the opening formed therethrough. In any case, an electrical circuit between the conductor connected to the spade lug 10 and a conductor electrically connected to the terminal is completed. The spade lug 10 of the present invention can be used with this type of terminal by simply inserting the extension 18 into the above-mentioned opening and either releasing the spring-loaded push button or advancing the nut over the post to secure the connection. The leg 16 does not interfere with the connection (as would be the case with a conventional spade lug) since it extends at an angle to the extension 18 and is shorter in length than the extension. Also, the angular disposition of the extension 18 relative to the leg 14 at the angle B as shown in FIG. 2 enables the leg 14 to extend horizontally into the opening in the terminal and the extension 18 to extend downwardly at an angle to the horizontal. This eliminates the lever arm which would otherwise be created if the extension was straight relative to the leg 14 and thus minimizes the stress on the connection between the conductor and the sleeve 12.

It is thus seen that several advantages result from the foregoing. For example, the spade lug 10 of the present invention can easily be utilized in connection with a conventional threaded binding post associated with a barrier strip, a terminal block, or an individual terminal by simply placing the two legs 14 and 16 around the binding post as described above, before the nut in threaded engagement with the binding post is advanced over the spade lug to complete the connection. Alternatively, the spade lug of the present invention can be used in connection with a terminal having an opening for receiving a pin type connector by inserting the extension 18 in the opening provided in the latter terminal before securing the connection in the manner described above.

Thus the spade lug 10 of the present invention provides an electrical connection between a conductor and one of several different types of terminals in a simple, quick and efficient manner.

Also, the spade lug of the present invention can be utilized with the most popular type of terminal connections without the necessity of replacing the spade lug with another type connector.

It is understood that variations may be made in the foregoing without departing from the scope of the invention. For example, the base portion of the spade lug 10 of the present invention is not limited to a sleeve as shown, but can be in the form of any other type of base portion suitable for electrical connection to a conductor.

Other modifications, changes and substitutions are intended in the foregoing disclosure and, in some instances, some features of the invention can be employed without a corresponding use of other features. Accordingly, it is appropriate that the appended claims be construed broadly and in a manner consistent with the scope of the invention.

What is claimed is:

1. A spade lug comprising a base member for receiving an electrical conductor, two legs extending from said base member in a spaced parallel relation, and an extension formed on one of said legs, said legs extending at an angle to said base member and said extension in one plane and said extension extending at an angle to said one leg in another plane.

2. The spade lug of claim 1 wherein said base member is in the form of a sleeve and wherein said legs extend at an angle to the axis of said sleeve.

3. The spade lug of claim 1 wherein the junction between said extension and said one leg is scored so that said extension can be snapped off said one leg.

4. The spade lug of claim 1 wherein said two legs are adapted to extend around a binding post forming a part of an electrical terminal and wherein said extension is adapted to extend within an opening defined by another terminal.

* * * * *